United States Patent [19]

Wagner et al.

[11] 4,030,334

[45] June 21, 1977

[54] PROCESS FOR THE MANUFACTURE OF COMPOSITE SECTIONS AND A DEVICE FOR CARRYING THIS OUT

[75] Inventors: Alfred Wagner, Steisslingen; Hermann Kidratschky, Hilzingen, both of Germany

[73] Assignee: Swiss Aluminium Ltd., Chippis, Switzerland

[22] Filed: Mar. 24, 1975

[21] Appl. No.: 561,239

[30] Foreign Application Priority Data

Mar. 23, 1974 Germany ..... 2414178

[52] U.S. Cl. ..... 72/258; 72/264; 72/269; 425/114; 425/380

[51] Int. Cl.[2] ..... B21C 23/24; B21C 25/04

[58] Field of Search ..... 72/268, 258, 253, 264, 72/269, 270, 260, 261, 263; 264/171, 174; 425/113, 114, 130, 131.1, 133.1, 133.5, 380

[56] References Cited

UNITED STATES PATENTS

| | | | |
|---|---|---|---|
| 2,741,363 | 4/1956 | Billen et al. | 72/268 |
| 3,152,059 | 10/1964 | Wellington | 72/258 X |
| 3,213,662 | 10/1965 | Lenz | 72/269 |
| 3,375,550 | 4/1968 | Klein | 425/114 |
| 3,697,209 | 10/1972 | Schiesser | 425/114 |
| 3,706,216 | 12/1972 | Weingarten | 72/258 |
| 3,841,127 | 10/1974 | Pashak | 72/258 X |
| 3,875,782 | 4/1975 | Kaplin et al. | 72/258 |

FOREIGN PATENTS OR APPLICATIONS

| | | | |
|---|---|---|---|
| 2,208,859 | 8/1973 | Germany | 72/261 |
| 437,075 | 10/1935 | United Kingdom | 72/261 |
| 308,787 | 5/1972 | U.S.S.R. | 72/261 |

*Primary Examiner*—C.W. Lanham
*Assistant Examiner*—D. M. Gurley
*Attorney, Agent, or Firm*—Ernest F. Marmorek

[57] ABSTRACT

A process for the manufacture of composite sections comprising at least two components. This is achieved by means of extrusion in particular using a light metal matrix, whereby at least one insert or similar component is fed into the stream of metal being extruded, on each side of the main axis in the region of the extrusion die bearing and covered all over with light metal as a result of pressure from all sides.

16 Claims, 7 Drawing Figures

Figure 1:
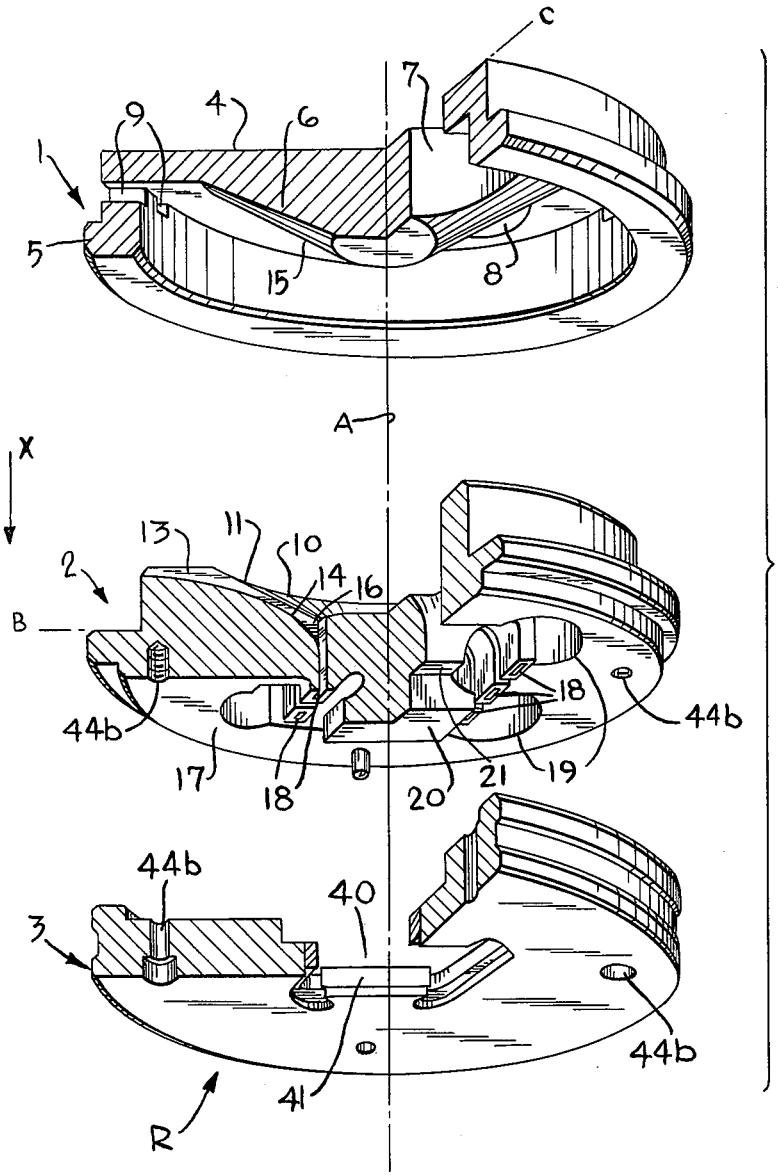

PROCESS FOR THE MANUFACTURE OF COMPOSITE SECTIONS AND A DEVICE FOR CARRYING THIS OUT

Reference is had to applicants' compending patent application Ser. No. 564,998, filed Apr. 4, 1975.

The invention concerns a process for the manufacture of composite sections by means of extrusion whereby the sections consist of at least two components and in particular where the matrix is a light metal, and concerns too a device for carrying this out.

the patent DT-AS No. 2,208,859 describes such a process and extrusion die for cladding metal extrusions with harder metals i.e. for the provision of an outer layer to a metal section. In that process a metal strip is fed through a gap in the side of the extrusion die, into the die chamber where it makes contact with the die through which it is forced along with the metal being extruded. Neither this process nor the equipment used is suitable for anything more than coating surfaces; the range of application is therefore very limited.

There exists too, a device for covering cable in which a hollow mandrel for guiding the insulated cable projects from the wall of the die into the center of the die opening.

This device, which was developed as early as 1948 is of importance exclusively in the processing of plastics; in the metal processing industry however it has not found any application and has not been able to contribute to solving the task facing the inventor who wants to achieve, in the simplest possible manner and mainly for light metals, the introduction of stabilising inserts into the core of straight composite extruded sections in a continuous extrusion operation.

In order to fulfill this objective, the inventors has the idea to introduce at least one insert into the extruded material on each side of the extrusions axis, into the die and to envelop these inserts, by means of pressure from all sides, in the material being extruded, in particular in a light metal alloy. The progression or the feeding-in of the inserts should take place without the inserts coming into contact with the die.

In terms of the invention the inserts are introduced into the die interior, radially with respect to the direction of flow of the extruded material and somewhat symmetrically to its axis. Thanks to the double sides symmetry, straight composite extrusions can now be manufactured, which is something not previously possible with the known devices. Because of the different thermal expansion coefficients of the materials used, thermal stresses arise on cooling down after extruding. These stresses however are symmetrical in the same way as the flow behaviour of the extruded metal in the die chamber and the welding zone.

The bond between the light metal or alloy matrix and the inserts can be mechanical, metallurgical or a combination of these. Since the metallurgical bond depends on diffusion and on the configuration of intermetallic compounds at the interface between the components, the provision of a third, intermediate metal e.g. as a covering on the inserts, can be of advantage in the invention. For connecting the components mechanically it is particularly useful to provide an insert shape e.g. dove tail grooving which promotes engagement between the components.

The device for carrying out the process is characterized such that in an extrusion die the tapered entrances of at least two feeding channels, which are spaced apart, project into the die interior and are for feeding-in inserts, and these feeding channels run approximately radially from the exterior to the interior of the die and approximately parallel to the direction of flow of the extruded material. A design falling within the scope of this invention but with only one feeding channel, is in terms of the present invention, considered as a poorer version by not allowing symmetrical loading.

A particularly favorable arrangement is one in which the feeding channels run in towards a central mandrel which allows the manufacture of hollow with projections such as are for example preferred for conductor rails. According to another feature of the invention the die for this process is made up of several pieces which are such that they can be readily made in the form of castings and are also easy to handle. The shape of the feeding channels, and cleaning them, are made simpler in a surprising manner by two plate shaped parts; these make up the feeding channels themselves which after removing the plate shaped parts appear as simple grooves.

A die design which has been found to be particularly good is one incorporating an entry plate, a mandrel plate, a die plate, and having six feed-in channels between the entry plate and the mandrel plate; the tapered ends of the feed-in channels project into the welding zone around the mandrel where the inserts emerging from the feed-in channels are surrounded by the material being extruded and finally emerge from the die travelling in the extrusion direction.

There are two preferred fields of application envisaged for this process viz., so called sliding contact sections and reinforced sections. Sliding contact sections are used mainly for conductor rails and constructional parts, the contact surfaces of which have to be wear resistant e.g. composite sections with embedded inserts of steel, copper or similar materials. Reinforced sections can be used as girders with an aluminum surface.

One significant advantage of the process of the invention is that extrusions of almost unlimited length can be produced.

Further advantages, features and details of the invention will be presented in the following descriptions of examples, making reference to diagrams as follows:

FIG. 1: An explosive view of a die showing some parts in section.

Figure 2:
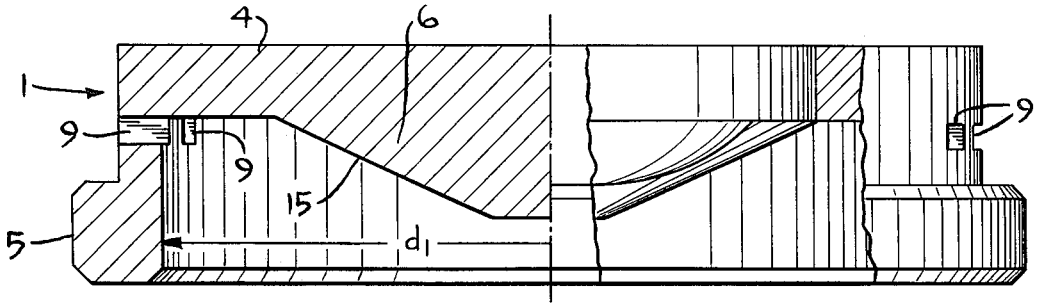
Figure 3:
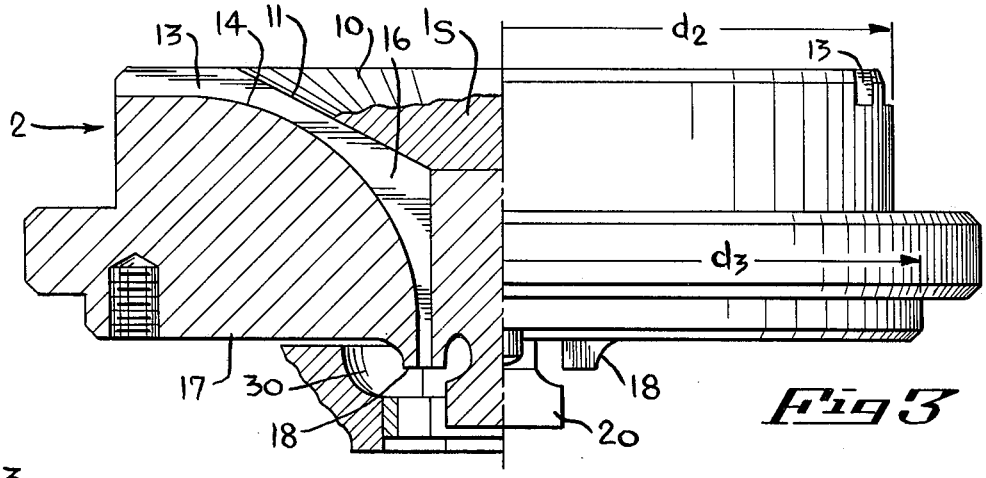
Figure 4:
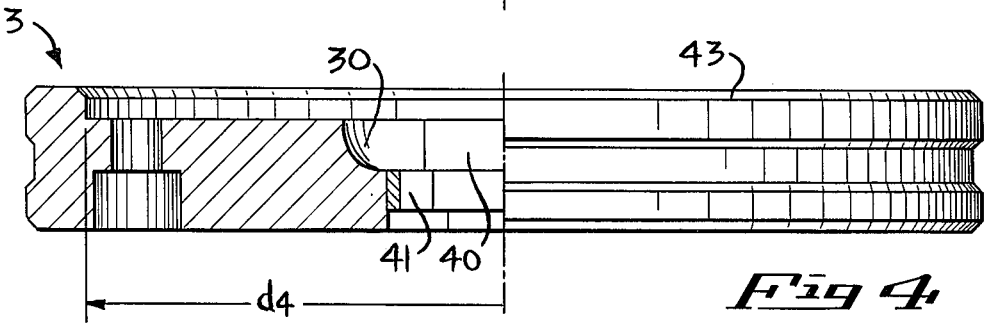

FIG. 2, FIG. 3, FIG. 4: Enlarged and partly sectioned views of the die shown in FIG. 1.

Figure 5:
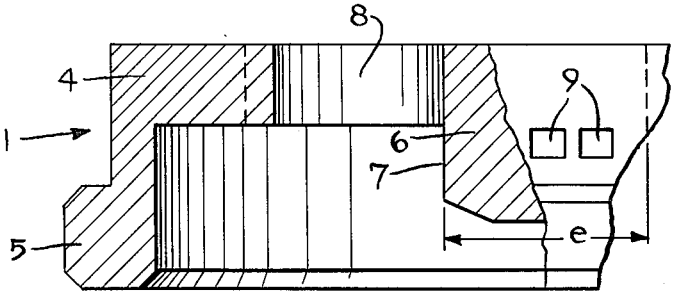

FIG. 5: A section along line C in FIG. 1.

Figure 6:
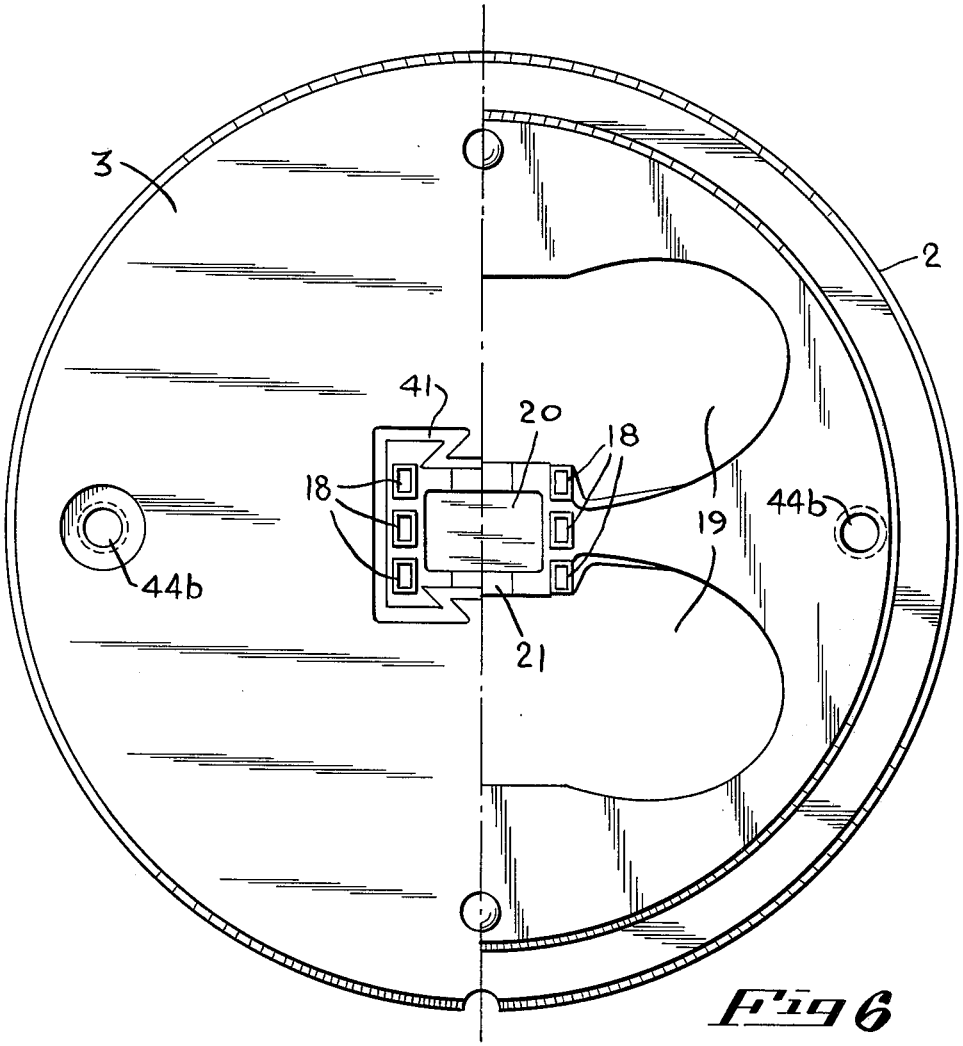

FIG. 6: Top view of the partly sectioned die.

Figure 7:
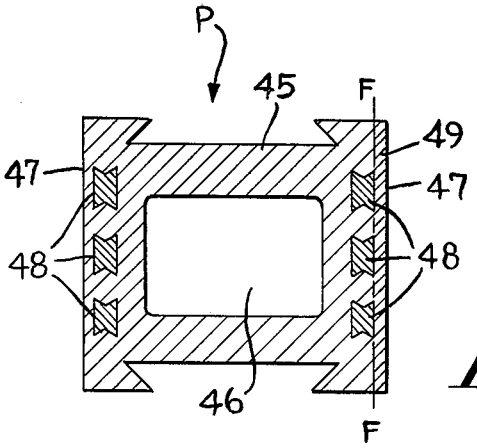

FIG. 7: A section through a hollow composite section produced with the die shown in FIGS. 1–6.

A basically cylindrical die R for extruding composite sections has, looking in the extruding direction X, an entry plate 1, a mandrel plate 2 onto which a die plate 3 is fitted.

The entry plate 1 consists of a base 4 surrounded by a collar 5 of inner radius $d_1$. The base 4 on the downstream side has a conical nose 6 and is cut on two sides parallel to the main axis A of the die R to produce approximately semi-oval faces 7. The latter are separated by a distance $e$ (FIG. 5) and each forms on either side of the conical nose 6 a side jaw wall to the holes 8 in the base 4.

In the region of the transverse axis which is parallel to the faces 7 there are provided on each side of the conical nose 6, three openings 9 in the collar 5 which run parallel to the collar radii and which are limited on one side by the base 4.

Fitting on to the conical nose 6 of the entry plate 1 there is a corresponding conical recess 10 in the mandrel plate 2 in the wall 11 of which, on both sides of the axis A, there are cut out three grooves 13 with convex curvature on the base 14; these grooves 13 connect up with the openings 9 in the entry plate 1 when parts 1 and 2 of the die are fitted together, and are covered, as shown in detail ls in FIG. 3, by the surface 15 of the conical nose 6 in such a way that they form curved channels 16 which, starting from the side openings 9 penetrate the mandrel plate 2 parallel to its axis and end at the bottom surface 17, as shown in the drawing here, as chimney-like tapered channels 18 of right-angled cross section. The holes 19 in the mandrel plate 2 also match up with the holes 8 in the base 4 of the entry plate 1.

The channels 18 flank the mandrel 20 in the mandrel plate 2, which provides a welding zone 30 when the die is assembled. In the die plate 3 there is a central hole 40 with inserted die bearing 41 which rests on the shoulders 21 of the mandrel 20 when the die is assembled.

As can be seen from FIGS. 2–4 the upper outer radius $d_2$ of the mandrel plate 2 is about equal to the inner radius $d_1$ of the entry plate 1 so that both die components 1 and 2 can be clamped together; in the same way the outer radius $d_3$ of the lower part of the mandrel plate 2 mates correspondingly to the inner radius $d_4$ of the collar ring 43 on the die plate 3. Additionally, the individual die components 1–3 are held together by bolts or screws which fit into the holes **44*b*** provided.

During the extrusion of a billet of an aluminum alloy (not shown here) through the channels formed by the holes 8 in the entry plate 1 and the holes 19 in the mandrel plate 2, a number of inserts, made of steel for example, are fed into the side of the die R and passed down through the channels 16. The inserts glide along the walls of these channels and made to turn through about 90° to run parallel to the main axis until they emerge from the described channels 18.

As a result of pressure on all sides in the welding zone 30 the inserts are surrounded by and bonded to the light metal which is being extruded and pass through without coming into contact with the die surface or the die bearing 41. The product of the co-extrusion is a hollow composite section P with an aluminum body 45 having a central hollow channel 46 and on both of the narrow sides 47 fully incorporated inserts 48 (see 18, FIG. 6) which are made for example of an abrasion resistant material. Such extruded sections P are used mainly as conductor rails or as constructional sliding components with abrasion resistant surfaces. These abrasion resistant surfaces are exposed after removal of the aluminum layer 49 up to the line F—F in FIG. 7.

Because of the symmetrical arrangement of the inserts 48 the composite section can also be used on both sides; if the sides are used in succession then the lifetime of the conductor-rail is clearly doubled.

The perfect embedding of the inserts 48 in the core prevents the possibility of contact corrosion; furthermore the inserts 48 can be coated, for example zinc on steel, as an additional protection against corrosion.

What we claim is:

1. An extrusion process for use in connection with an extrusion device including an entry plate, a mandrel plate, and a die plate defining a die bearing having an axis for manufacturing a composite section including at least a light metal and another metal, the steps comprising:

providing on opposite sides of said device channels defined by said entry plate and said mandrel plate, each of said channels having a first portion extending substantially radially and being defined substantially entirely by said entry plate, having a second portion extending along a curved path from said first portion and being defined substantially by the combination of said entry and mandrel plates, and having a third portion extending substantially axially from said second portion and being defined substantially entirely by said mandrel plate, said third portion projecting into an opening defined in said die plate;

supplying said light metal to said extrusion device;

supplying said other metal in a solid preformed state to said extrusion device through said channels for extrusion along with said light metal;

extruding said light metal, whereby said light metal flows while said other metal is substantially unchanged in its physical form.

2. The process as claimed in claim 1, wherein said other metal is supplied to be extruded in such a manner as to avoid substantially any contact with said die bearing.

3. The process as claimed in claim 1, wherein said other metal is supplied radially and symmetrical with respect to the supply of said light metal.

4. The process as claimed in claim 1, wherein said other metal is shaped to engage mechanically said light metal during the extrusion.

5. In an extrusion device for the manufacture of composite sectons including at least a light metal and another metal which is preformed, in combination, an entry plate and a mandrel plate, said entry plate extending for a portion into one side of said mandrel plate and defining therewith a plurality of channels forming passages for said other metal, each of said channels having a first portion extending substantially radially and being defined substantially entirely by said entry plate, having a second portion extending along a curved path from said first portion and being defined substantially by the combination of said entry and mandrel plates, and having a third portion extending substantially axially with respect to said plates from said second portion and being defined substantially entirely by said mandrel plate; and a die plate disposed adjacent the other side of said mandrel plate and defining a die bearing, said third portion projecting into said die plate;

the cross section through said first portion being generally larger than the cross section throughout said third portion, whereby the friction of said other metal through said channels during the extrusion is relatively minimized;

said entry plate and said mandrel plate defining an opening communicating with said die bearing for the extrusion of said light metal.

6. The device as claimed in claim 5, wherein said channels are defined in at least two of said plates.

7. The device as claimed in claim 6, wherein said channels are substantially symmetrical with respect to the movement of said metals through said die plate.

8. The device as claimed in claim 5, wherein said mandrel plate includes a mandrel and said channels are disposed at a distance from and on both sides of said mandrel.

9. The device as claimed in claim 6, wherein said mandrel plate near said entry plate has a recess defined which is at least partly tapered conically towards the central portion thereof and is flanked by holes defined therein which are parallel to the direction of movement of said metals through said die plate and said mandrel plate has grooves defined therein in the wall to form a part of said channels.

10. The device as claimed in claim 9, wherein there are a plurality of grooves extending radially with respect to said die plate.

11. The device as claimed in claim 9, wherein there are three grooves on each side of said device symmetrical of a vertical center plane and extending radially with respect to said die plate.

12. The device as claimed in claim 5, further comprising grooves defined in said mandrel plate and forming a portion of said channels, each of said grooves having a base curved towards the central portion of said mandrel plate and then extending substantially parallel to the movement of said metals through said die plates.

13. The device as claimed in claim 5, wherein said entry plate includes a covering surface and said mandrel plate includes a wall shaped to have a close fitting to said covering surface and a recess extending to a plurality of grooves defined therin to form closed-over channels.

14. The device as claimed in claim 13, wherein said covering surface is defined on a conical projection centrally disposed and projecting into a central opening of said mandrel plate.

15. The device as claimed in claim 5, wherein said die plate has a central opening defining a die bearing.

16. The device as claimed in claim 5, wherein said mandrel plate includes, a mandrel and said mandrel plate has projections that protrude into said die plate.

* * * * *